US008561984B2

(12) United States Patent
Mitsuya et al.

(10) Patent No.: US 8,561,984 B2
(45) Date of Patent: Oct. 22, 2013

(54) SHEET TAKE-OUT APPARATUS, SHEET PROCESSING APPARATUS, AND SHEET TAKE-OUT METHOD

(75) Inventors: Yusuke Mitsuya, Kanagawa-ken (JP); Yukio Asari, Kanagawa-ken (JP); Naruaki Hiramitsu, Kanagawa-ken (JP); Tetsuo Watanabe, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/915,508

(22) Filed: Oct. 29, 2010

(65) Prior Publication Data

US 2011/0042882 A1 Feb. 24, 2011

Related U.S. Application Data

(60) Division of application No. 12/402,914, filed on Mar. 12, 2009, now Pat. No. 7,845,629, which is a continuation of application No. PCT/JP2007/000986, filed on Sep. 10, 2007.

(30) Foreign Application Priority Data

Sep. 14, 2006 (JP) ..... 2006-249913
Mar. 29, 2007 (JP) ..... 2007-087191

(51) Int. Cl.
*B65H 7/02* (2006.01)
*B65H 1/18* (2006.01)
*B65H 5/22* (2006.01)

(52) U.S. Cl.
USPC ..... 271/265.01; 271/265.02; 271/152; 271/4.02; 271/4.03

(58) Field of Classification Search
USPC ..... 271/152–155, 265.01, 265.02, 4.02, 271/4.03
See application file for complete search history.

(56) References Cited

U.S. PATENT DOCUMENTS 4,077,620 A 3/1978 Frank et al.
4,357,007 A 11/1982 Mens Franciscus et al.
5,391,051 A 2/1995 Sabatier et al.

(Continued)

FOREIGN PATENT DOCUMENTS

EP 0 916 607 A2 5/1999
EP 0 990 609 A2 4/2000

(Continued)

OTHER PUBLICATIONS

Japanese Office Action dated. Jan. 5, 2011.

(Continued)

*Primary Examiner* — Patrick Cicchino
(74) *Attorney, Agent, or Firm* — Pillsbury Winthrop Shaw Pittman, LLP

(57) ABSTRACT

To provide a sheet take-out apparatus for preventing double feed of sheets and controlling gaps to a desired value, a sheet processing apparatus, and a sheet take-out method. A take-out apparatus includes a supply structure for supplying postal matter to a take-out position, a take-out structure for taking out the postal matter from the take-out position, and a conveying structure for receiving and conveying the postal matter taken out on a conveying path. When a leading edge of the postal matter is held by the conveying structure, an absorbing operation of a vacuum pump is stopped and a moving speed of a take-out belt is reduced. Furthermore, when the postal matter is detected by a sensor, the take-out belt is stopped.

10 Claims, 9 Drawing Sheets

(56) References Cited

U.S. PATENT DOCUMENTS

| | | | | |
|---|---|---|---|---|
| 5,664,771 | A | 9/1997 | Nagatani et al. | |
| 6,023,034 | A * | 2/2000 | Nakajima et al. | 209/584 |
| 6,076,821 | A * | 6/2000 | Embry et al. | 271/10.01 |
| 6,089,561 | A * | 7/2000 | Marshall et al. | 271/10.03 |
| 6,170,816 | B1 * | 1/2001 | Gillmann et al. | 271/10.03 |
| 6,554,275 | B1 * | 4/2003 | Tranquilla | 271/259 |
| 6,575,450 | B2 | 6/2003 | Blackwell et al. | |
| 7,068,969 | B2 * | 6/2006 | Ueda | 399/388 |
| 7,396,175 | B2 * | 7/2008 | Ueda | 400/708 |
| 7,600,753 | B2 * | 10/2009 | Katayama | 271/265.01 |
| 7,946,579 | B2 * | 5/2011 | Takenaka | 271/266 |
| 2009/0218751 | A1 * | 9/2009 | Kutzer et al. | 271/10.01 |

FOREIGN PATENT DOCUMENTS

| | | |
|---|---|---|
| JP | 63-267633 | 11/1988 |
| JP | 05-208755 | 8/1993 |
| JP | 2001-322727 | 11/2001 |
| JP | 2003-341860 | 12/2003 |
| JP | 2005-075630 | 3/2005 |
| JP | 2005-75630 | 3/2005 |

OTHER PUBLICATIONS

European Search Report dated Dec. 28, 2011.
European Search Report dated May 8, 2012.

* cited by examiner

UNIT [mm]

| GAP → | G (n-2) | G (n-1) | G' (n) |
|---|---|---|---|
| GREF → | 100 | 100 | 100 |
| | 0 ~ 50 | 0 ~ 50 | 300 |
| | 0 ~ 50 | 50 ~ 100 | 250 |
| | 0 ~ 50 | 100 ~ 150 | 200 |
| | 0 ~ 50 | 150 ~ 200 | 150 |
| ⋮ | 50 ~ 100 ⋮ | 0 ~ 50 ⋮ | ⋮ |

FIG. 8

SHEET TAKE-OUT APPARATUS, SHEET PROCESSING APPARATUS, AND SHEET TAKE-OUT METHOD

CROSS-REFERENCE TO RELATED APPLICATION

This application is a divisional of U.S. application Ser. No. 12/402,914, filed Mar. 12, 2009, now U.S. Pat. No. 7,845,629 and for which priority is claimed under 35 U.S.C. §121. U.S. application Ser. No. 12/402,914 is a continuation of International Application No. PCT/JP2007/000986, filed on Sep. 10, 2007. This application is based upon and claims the benefit of priority under 35 U.S.C. §119 from the prior Japanese Patent Application No. 2006-249913, filed on Sep. 14, 2006, and Japanese Patent Application No. 2007-87191, filed on Mar. 29, 2007. The entire contents of all of which are incorporated herein by reference in their entireties.

FIELD OF THE INVENTION

The present invention relates to a sheet take-out apparatus for taking out sheets in a stacking state one by one on a conveying path, a sheet processing apparatus having this sheet take-out apparatus, and a sheet take-out method.

DESCRIPTION OF THE BACKGROUND

Conventionally, as a sheet take-out apparatus for taking out a plurality of sheets in the stacking state one by one on the conveying path, a take-out apparatus for permitting a take-out roller to rotate in contact with sheets at one end in the stacking direction, thereby take out the concerned sheets in the surface direction almost orthogonal to the stacking direction is known (for example, refer to Japanese Patent Application Publication No. 2003-341860). This apparatus, after the sheets at one end in the stacking direction are taken out, moves the plurality of stacked sheets in the stacking direction and supplies the sheets at the end to the take-out position always in contact with the take-out roller. Further, this kind of take-out apparatus, for example, is incorporated into a postal matter processing apparatus for checking and sorting a plurality of postal matter.

The take-out apparatus has a separation structure for separating the second and subsequent sheets following the sheet taken out on the conveying path by the take-out roller. The separation structure includes a feed roller arranged on the same side as the take-out roller for the sheet taken out on the conveying path and on the downstream side of the take-out roller in the conveying direction and a separation roller arranged opposite to the position across the conveying path for the feed roller. When there are no sheets on the conveying path, the separation roller is pressed in the contact state by the feed roller.

The feed roller rotates so as to feed the sheets taken out on the conveying path in the forward direction. On the other hand, the separation roller, when there is one sheet between the feed roller and itself or there are no sheets, follows the feed roller and when a plurality of sheets are taken out on the conveying path in the stacking state and pass between the feed roller and itself, gives separation force in the opposite direction to the take-out direction to the second and subsequent sheets on the separation roller side. By doing this, the second and subsequent sheets are applied with brakes and are separated from the first sheet.

Generally, the aforementioned take-out roller, feed roller, and separation roller are composed of a rubber roller and act frictional force on sheets, thereby give conveying force. Therefore, the frictional force acted on sheets varies with the individual differences between the rollers, wear with time, and soil. Further, depending on the surface condition of each sheet, a slip is caused between the sheet and the rubber rollers. Namely, in a take-out apparatus using the conventional rubber rollers, the sheet take-out, separation, and conveyance cannot be controlled highly precisely to a desired condition.

Particularly in the conventional apparatus aforementioned, the take-out roller is rotated always at a fixed speed, so that between the taken-out sheets, gaps are hardly formed. Further, even when a plurality of sheets are taken out in the stacking state, the sheets separated by the separation force given by the separation roller are immediately started to be conveyed in the normal direction, so that gaps are hardly formed between the sheets. Therefore, in the conventional take-out apparatus aforementioned, the sheets are separated and taken out on the conveying path, and then the conveying speed of the sheets is changed stepwise, thus gaps are formed, though by this method, it is difficult to control the gaps between the sheets to a desired value.

Further, a sheet separation and conveyance apparatus including a double feed detection portion for detecting double feed of stacked sheets which are taken out on the conveying path by the take-out portion, a separation portion for separating a plurality of double-fed sheets, which are detected for double feed by the double feed detection portion, from each other, and a control portion, when double feed is detected by the double feed detection portion, for controlling the take-out portion so as to stop the take-out operation of the sheets by the take-out portion is known (for example, refer to Japanese Patent Application Publication No. 2001-322727). In the Patent Document 2, it is disclosed furthermore that the control portion controls so as to cause a speed difference between the first sheet and the second sheet, thereby form a gap between them, though a concrete measure for increasing or decreasing the gap length is not indicated.

On the other hand, as an apparatus for controlling the conveying gaps between sheets continuously taken out on the conveying path to an appropriate value, an apparatus for averaging measured data of the respective conveying gaps, comparing the mean data with theoretical data (a target value) prepared beforehand, when the mean data is larger than the theoretical data, advancing the sheet take-out timing so as to narrow the conveying gaps, and when the mean data is smaller than the theoretical data, delaying the sheet take-out timing so as to widen the conveying gaps is known (for example, refer to Japanese Patent Application Publication No. 2001-322727). Namely, this apparatus executes feedback control such as, when taking out the sheets, controlling the take-out timing by giving a fixed conveying gap, measuring the conveying gaps between the sheets after taking out the sheets, calculating the mean value thereof, comparing the calculation results with the target value, thereby controlling the sheet take-out timing.

However, by this method, the mean value of the conveying gaps can be converged to the target value, while a short gap occurring suddenly at the time of take-out of sheets cannot be corrected.

SUMMARY OF THE INVENTION

An object of the present invention is to provide a sheet take-out apparatus capable of preventing double feed of sheets and controlling the gap between the preceding sheet and the succeeding sheet during conveyance to a desired value, a sheet processing apparatus, and a sheet take-out method.

To accomplish the above object, the sheet take-out apparatus of the present invention includes a take-out structure configured to make contact with a sheet supplied to a take-out position at one end in a stacking direction and rotating, thereby take out the sheet in a face direction; a conveying structure configured to receive, hold, restrict, and furthermore convey the sheet taken out on a conveying path by the take-out structure; a first detection portion configured to detect that the sheet taken out on the conveying path is transferred to the conveying structure and is held and restricted; a second detection portion configured to detect the sheet on a downstream side of the first detection portion in a sheet conveying direction; a gap sensor provided on the conveying path between the take-out position and the first detection portion configured to detect gaps between the sheets taken out on the conveying path; and a control portion configured to control a rotational speed of the take-out structure to almost the same speed as a conveying speed by the conveying structure, when detecting the sheet taken out on the conveying path by the first detection portion, reducing the rotational speed of the take-out structure, and when further detecting the sheet via the second detection portion without detecting a gap between the sheet and a succeeding sheet, reducing furthermore the rotational speed of the take-out structure.

Further, the sheet take-out apparatus of the present invention includes a take-out belt having many holes configured to make contact with a sheet supplied to a take-out position at one end in a stacking direction and moving in a face direction; a motor configured to permit the take-out belt to move at various speeds; a suction portion configured to suck in air from a rear side opposite to the take-out position of the take-out belt, act a negative pressure on the sheet supplied to the take-out position via the many holes, and absorb the sheet to the take-out belt; a conveying structure configured to receive, hold, restrict, and furthermore convey the sheet absorbed to the take-out belt and taken out on the conveying path extending on a downstream side of the take-out position in a take-out direction; a first detection portion configured to detect that the sheet taken out on the conveying path is received by the conveying structure; a second detection portion configured to detect a sheet on a downstream side of the first detection portion in a sheet conveying direction; a gap sensor provided on the conveying path between the take-out position and the first detection portion configured to detect gaps between the sheets taken out on the conveying path; and a control portion configured to control a moving speed of the take-out belt to almost the same speed as a conveying speed by the conveying structure, when detecting a leading edge of the sheet taken out on the conveying path in the conveying direction by the first detection portion, control a suction operation by the suction portion so as to at least decrease the negative pressure acting on the take-out position, control the motor so as to reduce the moving speed of the take-out belt, and when further detecting the leading edge of the sheet in the conveying direction via the second detection portion without detecting a gap between the sheet and a succeeding sheet, control the motor so as to increase the negative pressure and reduce furthermore the moving speed of the take-out belt.

Further, the sheet take-out method of the present invention includes an absorbing step of acting a negative pressure on a sheet supplied to a take-out position at one end in a stacking direction and permitting a take-out member to absorb the sheet; a take-out step of permitting the take-out member to make contact with the sheet absorbed at the absorbing step and rotate, thereby taking out the sheet in a face direction thereof; a conveying step of receiving and furthermore conveying the sheet taken out on the conveying path at the take-out step by the conveying structure on a downstream side; a first deceleration step of, when receiving the sheet taken out on the conveying path by the conveying structure, at least reducing absorption force for absorbing the sheet supplied to the take-out position to the take-out member and reducing a rotational speed of the take-out member; and a second deceleration step of, when the sheet received by the conveying structure is conveyed furthermore at a fixed distance, if no gap is formed between the sheet and a succeeding sheet, reducing the absorption force for absorbing the sheet supplied to the take-out position to the take-out member and reducing furthermore the rotational speed of the take-out member.

Further, the sheet take-out method of the present invention includes a step of, so as to control gaps between taken-out sheets to a target value, continuously taking out a plurality of sheets from a take-out position on a conveying path; a step of detecting the gaps between the sheets taken out from the take-out position and conveyed via the conveying path; and a step of, on the basis of a first gap between a first sheet under take-out from the take-out position and a second sheet taken out and conveyed precedingly on the conveying path and a second gap between a third sheet taken out and conveyed further precedingly on the conveying path and the second sheet, controlling the take-out operation of the first sheet.

Further, the sheet take-out apparatus of the present invention includes a take-out structure, so as to control gaps between sheets taken-out on a conveying path to a target value, configured to continuously take out a plurality of sheets from a take-out position on the conveying path; a gap detection portion configured to detect the gaps between the sheets taken out by the take-out structure and conveyed via the conveying path; and a control portion, on the basis of a first gap between a first sheet detected by the gap detection portion and under take-out by the take-out structure and a second sheet taken out and conveyed precedingly on the conveying path and a second gap between a third sheet taken out and conveyed further precedingly on the conveying path and the second sheet, configured to control the take-out operation of the first sheet by the take-out structure.

BRIEF DESCRIPTION OF THE DRAWINGS

FIG. 8 is a drawing showing an example of the data table referred to under control for the take-out operation of postal matter under take-out;

DETAILED DESCRIPTION OF THE INVENTION

Figure 1:
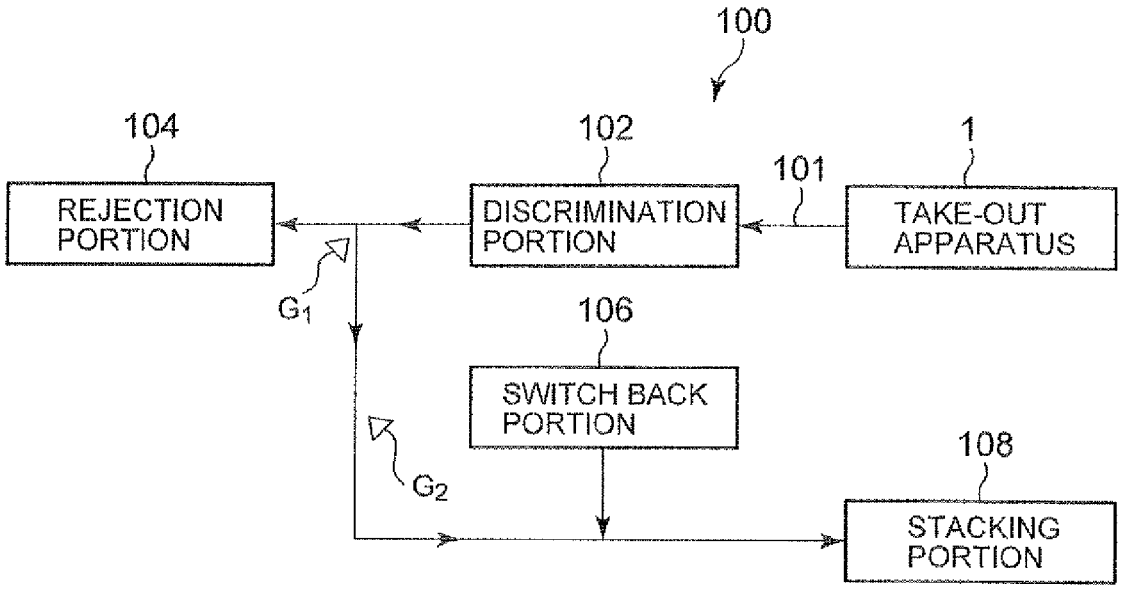
FIG. 1 is a block diagram showing the constitution of the postal matter processing apparatus relating to the embodiments of the present invention.

Hereinafter, the embodiments of the present invention will be explained in detail with reference to the accompanying drawings. In FIG. 1, the schematic constitution of a postal matter processing apparatus 100 (hereinafter, referred to as just the processing apparatus 100) including a sheet take-out apparatus 1 (hereinafter, referred to as just the take-out apparatus 1) relating to the embodiments of the present invention is shown in a block diagram. The processing apparatus 100, in addition to the take-out apparatus 1, includes a discrimination portion 102, a rejection portion 104, a switch back portion 106, and a stacking portion 108. Further, a sheet processed by the processing apparatus 100 of this embodiment is postal matter, though the processed media (that is, sheets) are not limited to postal matter.

Postal matter is set in the take-out apparatus 1 in the stacking state and if the take-out apparatus 1 is operated as described later, it is taken out one by one on a conveying path 101. On the conveying path 101, a plurality of conveying endless belts not drawn are extended so as to hold the conveying path 101 between them and postal matter is held and conveyed between the conveying belts.

The postal matter taken out on the conveying path 101 passes through the discrimination portion 102 and various information is read here from the postal matter. The discrimination portion 102, on the basis of the various read information, discriminates the conveying posture and sorting destination of the postal matter. Particularly, the discrimination portion 102 reads the destination information such as the zip code and address which are written on the postal matter and discriminates the sorting destination.

The postal matter passing through the discrimination portion 102 is distributed in the conveying direction via a gate G1. Namely, the postal matter discriminated as postal matter to be rejected by the discrimination portion 102 is conveyed to the rejection portion 104 via the gate G1 and the other postal matter is conveyed to the stacking portion 108 via the gate G1.

At this time, when the discrimination portion 102 discriminates that the conveying direction of the concerned postal matter must be reversed, the postal matter is sent to the switch back portion 106 via the gate G2 and the conveying direction is reversed here. The postal matter not required to reverse the conveying direction is permitted to bypass the switch back portion 106 via the gate G2 and is conveyed to the stacking portion 108.

The postal matter sent to the stacking portion 108 via the conveying path 101 is sorted and stacked in the sort and stack pocket not drawn according to the discrimination results by the discrimination port 102. The postal matter sorted and stacked in each sort and stack pocket is stacked in the state that the top and bottom are arranged properly.

Figure 2:
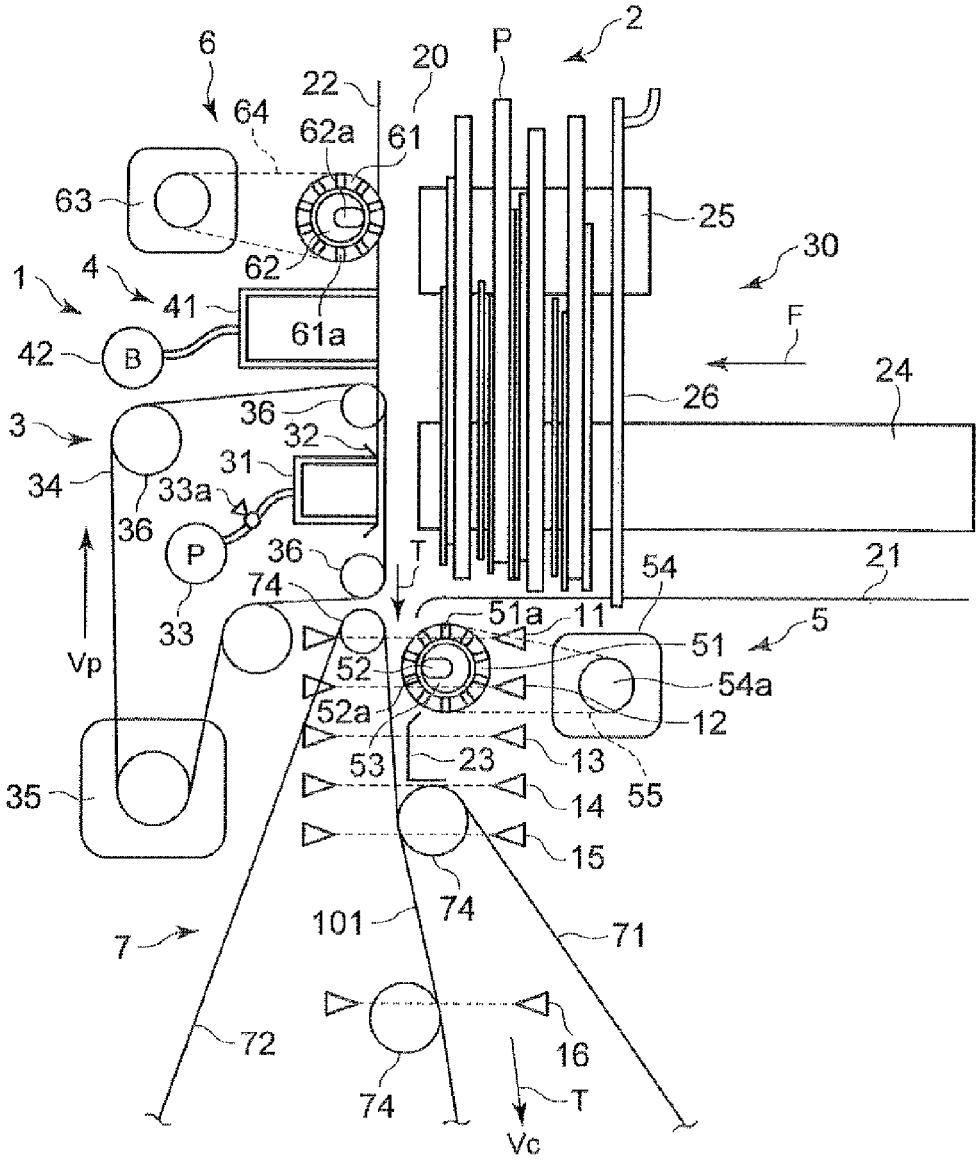
FIG. 2 is a schematic view showing the constitution of the take-out apparatus incorporated in the processing apparatus shown in FIG. 1.

FIG. 2 shows a plan view of the take-out apparatus 1 viewed from above. Further, FIG. 3 shows a block diagram of the control system for controlling the operation of the take-out apparatus 1.

As shown in FIG. 2, the take-out apparatus 1 includes an insertion portion 2 for inserting a plurality of postal matter P in the stacking state, a supply structure 30 for moving the plurality of inserted postal matter P in the stacking direction and supplying the postal matter P at the leading edge in the moving direction to a take-out position 20, a take-out structure 3 for taking out the postal matter P supplied to the take-out position 20 on the conveying path 101, a suction structure 4 for sucking the postal matter P at the leading edge in the stacking direction among the postal matter P inserted via the insertion portion 2, a separation structure 5 for separating the second and subsequent postal matter P following the postal matter P taken out from the take-out position 20, an auxiliary structure 6 for acting a negative pressure on the postal matter P supplied to the take-out position 20 from the take-out structure 3 on the upstream side in the take-out direction, moving it in both forward and backward directions, thereby assisting the take-out operation, and a conveying structure 7 for pulling out the postal matter P passing through the separation structure 5 and conveying it on the downstream side.

Figure 3:
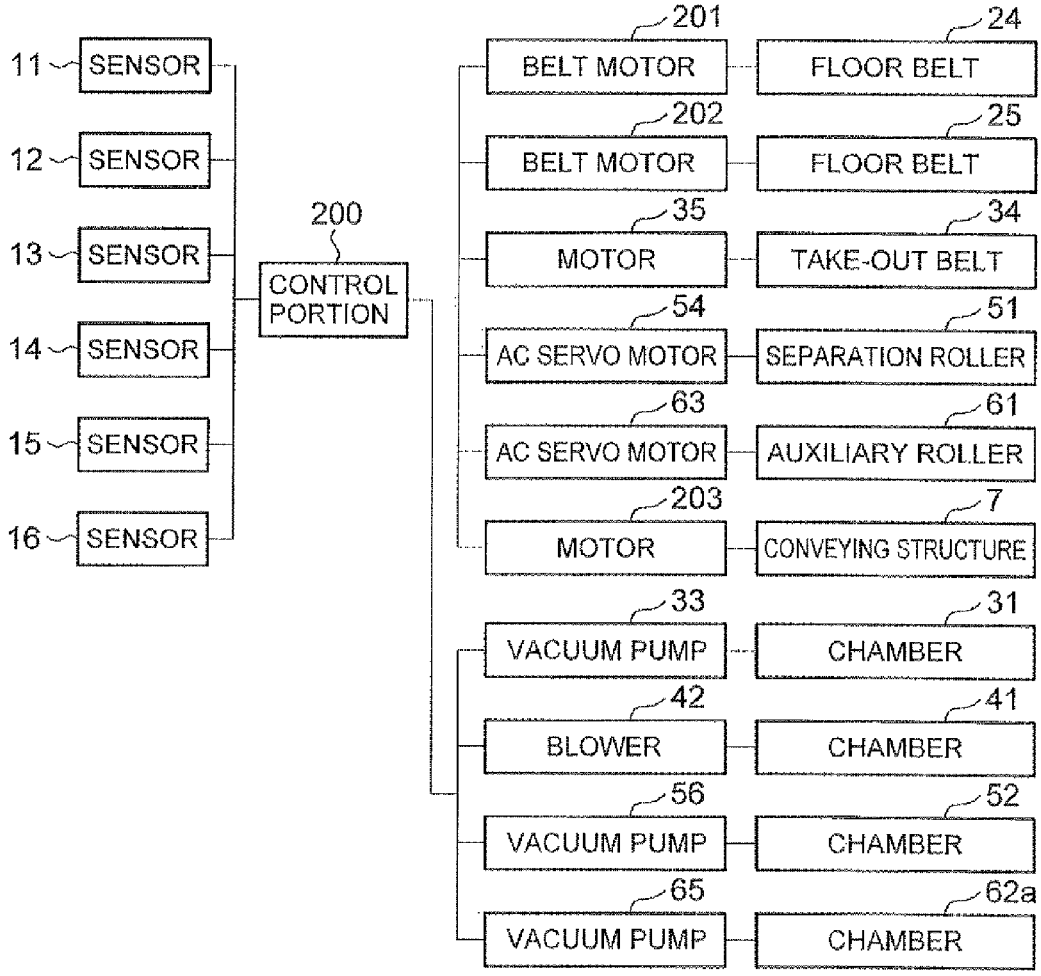
FIG. 3 is a block diagram of the control system for controlling the operation of the take-out apparatus shown in FIG. 2.

Further, the take-out apparatus 1, as shown also in FIG. 3, has sensors 11, 12, 13, 14, 15, and 16 for detecting passing of the postal matter P taken out from the take-out position 20 at one end of the insertion portion 2 on the conveying path 101. Each of the sensors 11 to 16 has a light emission portion and a light receiving portion so as to hold the conveying path 102 through which the postal matter P passes between them and detects that the concerned postal matter P passes when the postal matter P interrupts the optical axis thereof. Particularly, the fifth sensor 15 from the upstream side in the take-out direction of the postal matter P functions as a first detection portion of the present invention and the sixth sensor 16 on the lowermost stream side functions as a second detection portion of the present invention. The residual four sensors 11 to 14 function as a gap sensor for detecting the gaps between the postal matter P taken out on the conveying path 101.

The first detection portion 15 is arranged at the position where the distance from the leading edge of the postal matter P supplied to the take-out position 20 in the take-out direction up to the detection position where the optical axis of the sensor is interrupted becomes almost the same length as that of the postal matter P with a smallest length in the take-out direction (hereinafter, such postal matter is referred to as smallest postal matter) among the postal matter P processed by the processing apparatus 100. In other words, the first detection portion 15 detects that the postal matter P taken out on the conveying path 101 is transferred to the conveying structure 7. In this embodiment, the length of smallest postal matter is set at 135 [mm].

The second detection portion 16 is arranged at the position where the distance from the leading edge of the postal matter P at the take-out position 20 up to the detection position of the postal matter becomes almost the same length as that of the postal matter P with a longest length (hereinafter, such postal matter is referred to as longest postal matter). Namely, when the second detection portion 16 detects passing of the leading edge of the postal matter P, the rear end of the concerned postal matter P is not at the take-out position 20. In this embodiment, the length of largest postal matter is set at 250 [mm].

Furthermore, the take-out apparatus 1 has a plurality of conveying guides 21, 22, and 23 for permitting the end sides and surfaces of the postal matter P to make contact with each other, thereby guiding the movement and conveyance thereof.

Into the insertion portion 2, a plurality of sheets P are inserted in a batch in the stacking state and in the upright state. On the bottom of the insertion port 2, two floor belts 24 and 25 for permitting the lower end sides of the respective postal matter P to make contact with each other and moving them in the stacking direction (in the direction of the arrow F shown in the drawing) are arranged. Further, among the plurality of postal matter P, at the position opposite to the postal matter P at the rear end in the moving direction, a backup plate 26 for moving in the direction of the arrow F in cooperation with the floor belts 24 and 25, thereby supplying the postal matter P at the leading edge in the moving direction to the take-out position 20 is arranged. The backup plate 26 is connected to, among the two floor belts 24 and 25, the floor belt 24 comparatively long on the downstream side in the take-out direction and by moving the floor belt 24, moves in the direction of the arrow F.

Further, the conveying guide 21 extending along the floor belt 24 is extended up to the position for specifying one side of the insertion portion 2 in the direction of the arrow F and guides the postal matter P by permitting the end sides thereof to make contact with each other. Further, the conveying guide 22 is arranged on the opposite side of the insertion portion 2 at the take-out position 20, and functions so as to stop the postal matter P at the leading edge in the moving direction, which is supplied in the direction of the arrow F, at the take-out position, and functions so as to make contact with one surface of the postal matter P taken out from the take-out position 20 and guide it. Furthermore, the conveying guide 23 arranged between the separation structure 5 and the conveying structure 7 functions so as to guide the leading edge of the postal matter P in the conveying direction, which is taken out on the conveying path 101, toward the nip of the conveying structure 7 which will be described later.

The take-out structure 3 includes a chamber 31, a guide 32, and a vacuum pump 33 (or an equivalent article) (a suction portion). In the middle of the pipe for connecting the chamber 31 and vacuum pump 33, an electromagnetic valve 33*a* for turning on or off the negative pressure is provided. Further, the take-out structure 3 includes an endless take-out belt 34 (a take-out member) that at least a portion in a fixed area moves in the direction of the arrow T (in the take-out direction of the postal matter P) shown in the drawing along the take-out position 20 and a motor 35 for driving the take-out belt 34. The take-out belt 34, so that at least a part thereof moves in the direction of the arrow T shown in the drawing along the take-out position 20, is wound and stretched by a plurality of rollers.

The guide 32 is arranged at the position opposite to the take-out position 20 inside and across the take-out belt 34. The chamber 31 is arranged at the position opposite to the take-out position 20 on the rear side of the guide 32, that is, across the take-out belt 34 and guide 32. The take-out belt 34 has many absorbing holes not shown in the drawing. Further, the guide 32 has a plurality of long and narrow slits not drawn in the moving direction T of the take-out belt 34.

And, if the vacuum pump 33 is operated, and the electromagnetic valve 33*a* is opened, and the chamber 31 is evacuated, via the opening (not drawn) of the chamber 31 opposite to the guide 32, the plurality of slits of the guide 32, and the many absorbing holes of the take-out belt 34 moving in the direction of the arrow T, a negative pressure is acted on the postal matter P supplied to the take-out position 20 and the postal matter P is absorbed to the surface of the take-out belt 34. To stop the absorbing operation, the electromagnetic valve 33*a* is closed and the negative pressure is turned off.

The absorbing force by the vacuum pump 33 is set so that the conveying force for discharging the first postal matter P absorbed to the take-out belt 34 in the take-out direction T becomes larger than the frictional force acting between the first sheet and the second sheet. The take-out structure 3, basically, separates the postal matter P at the take-out position 20 one by one and discharges them onto the conveying path 101, though double feed postal matter discharged onto the conveying path 101 in the stacking state of a plurality of sheets is separated one by one by the separation structure 5 which will be described later.

The suction structure 4 includes a chamber 41 arranged on the rear side of the conveying guide 22 for the take-out position 20 and a blower 42 (or an equivalent article) for sucking air in the chamber 41. The chamber 41, between the take-out structure 3 aforementioned and the auxiliary structure 6 which will be described later, is arranged in the neighborhood of the take-out position 20 in a posture that the opening not drawn is made opposite to the rear of the guide 22. Further, the guide 22 has a plurality of holes not drawn in accordance with the opening width of the chamber 41.

And, if the blower 42 is operated and air in the chamber 41 is sucked, an air flow toward the opening of the chamber 41 is formed via the plurality of holes of the guide 22 and among a plurality of postal matter P inserted into the insertion portion 2, the postal matter P closest to the take-out position 20 is sucked toward the take-out position 20. After the postal matter P sucked in the take-out position 20 is taken out, the next postal matter P is sucked toward the take-out position 20. Namely, by installation of the suction structure 4, the postal matter P to be taken out next can be supplied quickly to the take-out position 20 and even if the supply force by the supply structure 30 in the direction of the arrow F is weak, only the first postal matter P can be always stably supplied quickly to the take-out position 20. By doing this, the take-out operation of the postal matter P by the take-out structure 3 aforementioned can be speeded up.

The separation structure 5 is provided on the opposite side to the take-out structure 3 for the conveying path 101 extending on the downstream side (downward in FIG. 2) of the take-out position 20. The separation structure 5, by acting a negative pressure on the postal matter P conveyed via the conveying path 101 from the opposite side to the take-out structure 3, gives separation force in the opposite direction to the take-out direction of the postal matter P to it. Namely, the separation structure 5 is operated, thus even when the second and subsequent postal matter P (three or more sheets may be stacked and taken out) follow the postal matter P taken out from the take-out position 20, the second and subsequent postal matter P are stopped or returned in the opposite direction by the aforementioned negative pressure and separation force and are separated from the first postal matter P.

More in detail, the separation structure 5 has an almost cylindrical separation roller 51 which is provided so as to rotate in both forward and backward directions in the take-out direction T of the postal matter P. The separation roller 51 is rotatably attached to the rotary shaft fixedly attached to the conveying path 101, that is, a cylinder body 53 having a chamber 52 via a bearing not drawn and has many absorbing holes 51*a* passing through so as to connect the inner peripheral surface and outer peripheral surface.

The separation roller 51 is made of a rigid body such as an almost cylindrical metallic material and is positioned to and arranged in the place where the outer peripheral surface thereof is exposed on the conveying path 101. Further, the cylindrical body 53 as a rotary shaft has the chamber 52 for generating a negative pressure and an opening 52*a* of the chamber 52 is positioned and fixed in a posture facing the conveying path 101.

Further, the separation structure 5 includes an AC servomotor 54 for rotating the separation roller 51 in both forward and backward directions at desired torque and an endless timing belt 55 for transferring the drive force by the motor 54 to the separation roller 51. The timing belt 55 is wound and stretched by a pulley 54*a* fixed to the rotary shaft of the motor 54 and a pulley not drawn which is fixed to the separation roller 51. Furthermore, the separation structure 5 has a vacuum pump 56 (or an equivalent article) (FIG. 3) connected to the chamber 52 of the cylindrical body 53 with the separation roller 51 attached rotatably via a pipe not drawn.

And, if the vacuum pump 56 is operated and the chamber 52 is evacuated, via the opening 52*a* of the chamber 52 and among the many absorbing holes 51*a* of the separation roller 51, a specific absorbing hole opposite to the opening 52*a*, a negative pressure is acted on the surface of the postal matter P passing through the conveying path 101 and the concerned postal matter P is absorbed to the outer peripheral surface of the separation roller 51. At this time, when the separation roller 51 is being rotated, also to the postal matter P absorbed to the outer peripheral surface of the separation roller 51, the conveying force in the rotational direction of the separation roller 51 is given.

The auxiliary structure 6 arranged above the suction structure 4, that is, on the upstream side in the take-out direction of the postal matter P has almost the same structure as that of the separation structure 5. Namely, the auxiliary structure 6 has an auxiliary roller 61 provided rotatably in both forward and backward directions in the take-out direction of the postal matter P.

The auxiliary roller 61 is rotatably attached to the rotary shaft fixedly provided opposite to the take-out position 2, that is, a cylindrical body 62 internally having a chamber 62*a* and has many absorbing holes 61*a* passing through so as to connect the inner peripheral surface and outer peripheral surface. Further, the auxiliary roller 61 is made of a rigid body such as an almost cylindrical metallic material and is positioned to and arranged in the place where the outer peripheral surface thereof is exposed at the take-out position 20. Further, the cylindrical body 62 as a rotary shaft is positioned and fixed in a posture that the opening of the chamber 62*a* faces the take-out position 20.

Further, the auxiliary structure 6 includes an AC servomotor 63 for rotating the auxiliary roller 61 in both forward and backward directions at a desired speed and an endless timing belt 64 for transferring the drive force by the motor 63 to the auxiliary roller 61. Furthermore, the auxiliary structure 6 has a vacuum pump 65 (or an equivalent article) connected to the chamber 62*a* of the cylindrical body 62 with the auxiliary roller 61 attached rotatably via a pipe not drawn.

And, the auxiliary structure 6 rotates and stops the auxiliary roller 61 in both forward and backward directions at a desired speed and acts a negative pressure on it by the vacuum pump 65, thereby supports the take-out operation and separation operation of the postal matter P. For example, when taking out the postal matter P supplied to the take-out position 20 by the take-out structure 3, the auxiliary structure 6 acts a negative pressure on the rear end of the postal matter P in the take-out direction and absorbs it, then rotates in the forward direction, and supports the take-out of the postal matter P. By doing this, for example, when taking out large postal matter P which is comparatively heavy, the auxiliary structure 6 can give larger conveying force than that when taking out ordinary postal matter P, thus the take-out operation of the postal matter P can be stabilized.

Further, the auxiliary structure 6, in the state that the first postal matter P is taken out by the take-out structure 3, absorbs the rear end of the second postal matter P supplied to the take-out position after the first postal matter P is taken out, rotates it in the opposite direction at a desired speed, can apply brake, and can prevent double feed of the postal matter P in cooperation with the separation structure 5. In this case, the auxiliary structure 6 controls the speed in the opposite direction which is given to the auxiliary roller 61, and controls the braking time, thereby can control the gap and pitch of the postal matter P taken out from the take-out position 20 onto the conveying path 101.

The conveying structure 7 has two conveying belts 71 and 72 arranged so as to hold the conveying path 101 extending on the downstream side of the take-out position 20 between them. The conveying belts 71 and 72 respectively have two belts not drawn which are lined up in the direction of the sheet surface and are wound and stretched by a plurality of conveying rollers 74. And, with respect to the postal matter P conveyed in the direction of the arrow T via the conveying path 101, the leading edge thereof in the conveying direction is received between the conveying belts 71 and 72 and are held and restricted and is conveyed further on the downstream side due to movement of the conveying belts 71 and 72.

As shown in FIG. 3, to a control portion 200 for controlling the operation of the take-out apparatus 1, six sensors 11, 12, 13, 14, 15, and 16 provided on the conveying path 101 extending on the downstream side of the take-out position 20 are connected. Further, to the control portion 200, two belt motors 201 and 202 for independently driving the two floor belts 24 and 25 of the supply structure 30, the motor 35 for moving the take-out belt 34 at variable speeds, the AC servomotor 54 for giving the separation force to the separation roller 51, the AC servomotor 63 for rotating the auxiliary roller 61 in both forward and backward directions at an optional speed, and a motor 203 for moving the conveying belts 71 and 72 of the conveying structure 7 at a fixed speed are connected. Furthermore, to the control portion 200, the vacuum pump 33 for evacuating the chamber 31 of the take-out structure 3, the blower 42 for generating an air flow in the chamber 41 of the suction structure 4, the vacuum pump 56 for evacuating the chamber 52 of the separation structure 5, and the vacuum pump 65 for evacuating the chamber of the auxiliary structure 6.

And, the postal matter P set in the insertion portion 2 is sent in the direction of the arrow F shown in the drawing by the supply structure 30 and the postal matter P at the leading edge in the supply direction is pulled near the take-out position 20 by the suction structure 4. The suction structure 4 is provided at the take-out position 20 like this, thus even if the supply force of the postal matter P by the supply structure 30 is small, the first postal matter P can be arranged quickly at the take-out position 20.

The postal matter P pulled near the take-out position 20 is absorbed to the surface of the take-out belt 34 of the take-out structure 3, receives the conveying force from the take-out belt 34 in this state, and is discharged in the take-out direction T. The postal matter P discharged on the conveying path 101, in the state that the passing is detected via the six sensors 11 to 16, is further conveyed on the downstream side via the conveying path 101 in the state that it is pulled out by the conveying structure 7.

At this time, a negative pressure is acted via the separation roller 51 of the separation structure 5, and the separation force in the take-out direction and opposite direction is given, and the second and subsequent postal matter P following the first postal matter P taken out from the take-out position 20 are separated. Further, at this time, the negative pressure is acted on the rear end side at the take-out position 20 in the take-out direction via the auxiliary roller 61 of the auxiliary structure 6 and the take-out operation of the postal matter P at the take-out position 20 is assisted.

Hereinafter, among the aforementioned operations by the take-out apparatus 1 having the aforementioned structure, particularly, the operation of the take-out structure 3 which is a characteristic of the present invention will be explained by referring to the flow chart shown in FIG. 4. Further, the take-out structure 3 is operated by the control portion 200, and the output of the six sensors 11 to 16 is monitored by the control portion 200, and the motor 35 of the take-out belt 34 and the vacuum pump 33 are controlled.

Figure 4:
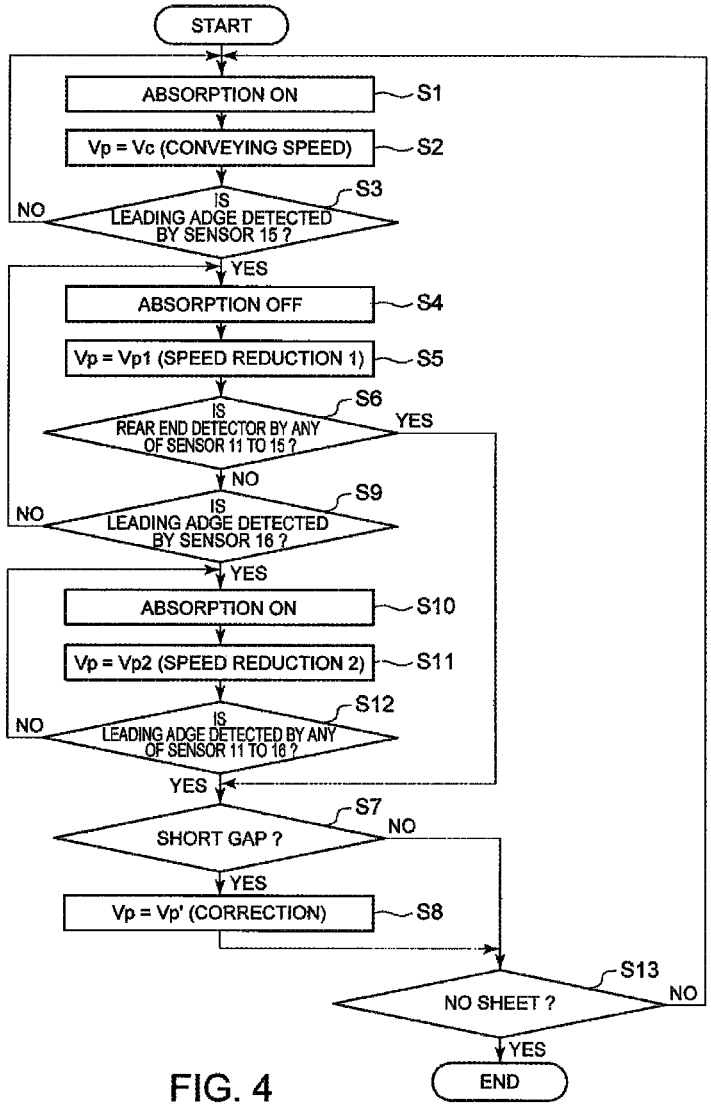
FIG. 4 is a flow chart for explaining the operation of the take-out belt of the take-out apparatus shown in FIG. 2.

As shown at Step S1 in FIG. 4, the control portion 200 firstly operates the vacuum pump 33 of the take-out structure 3, evacuates the chamber 31, opens the electromagnetic valve 33*a*, thereby generates absorbing force in the take-out belt 34. And, the control portion 200 drives the motor 35 and moves the take-out belt 34 at a speed of Vp m/s] in the take-out direction (in the direction of the arrow T) (Step S2). By doing this, the postal matter P supplied to the take-out position 20 by the supply structure 30 is discharged onto the conveying path 101. At this time, the initial moving speed Vp [m/s] of the take-out belt 34 is set to almost the same speed as the conveying speed Vc [m/s] f the postal matter P by the conveying structure 7 on the downstream side. In this embodiment, the speeds Vp and Vc are set to 4 [m/s].

Hereafter, the control portion 200 monitors the output of the sensor 15 at the holding position of the conveying structure 7 and detects the passing of the leading edge of the postal matter Pin the take-out direction which is taken out on the conveying path 101 by the take-out belt 34 (Step S3). And, the control portion 200, using it as a trigger that the leading edge of the concerned postal matter P is detected via the sensor 15 (YES at Step S3), turns off the electromagnetic valve 33*a* of the vacuum pump 33, stops the suction operation by the vacuum pump 33, reduces the absorbing force by the take-out belt 34 to almost zero (Step S4), controls the motor 35, and reduces the moving speed of the take-out belt 34 to Vp1 [m/s] (Step S5). Further, in this embodiment, the suction force by the vacuum pump 33 is reduced to almost zero at Step S4, though it is desirable to reduce at least the suction force. Further, in this embodiment, the moving speed Vp1 of the take-out belt 34 reduced at Step S5 is set at 2 [m/s].

"Reduce the suction force" mentioned above means to weaken the force for absorbing the postal matter P at the take-out position 20 to the take-out belt 34 and it is almost the same meaning as "reduce the negative pressure". Further, inversely, when "increasing the suction force" or "increasing the negative pressure", it means that the absorbing force for the postal matter P to the take-out belt 34 is increased.

Therefore, the first postal matter P in the held and restricted state by the conveying structure 7 is conveyed to the succeeding processing portion (not drawn) at a speed of Vc, and the discharging force to the succeeding postal matter P supplied next to the take-out position 20 can be weakened, and the discharging speed can be made slow, thus the separation operation by the separation structure 5 can be assisted.

Namely, after the preceding postal matter P is transferred to the conveying structure 7, before starting the discharging operation for the next postal matter P, the discharging force by the take-out structure 3 is not necessary, and particularly when the preceding postal matter P is smallest postal matter P, the discharging speed for the succeeding postal matter P can be made slow, and a gap can be formed between them.

After reducing the moving speed of the take-out belt 34 at Step S5, the control portion 200 monitors the output of the sensors 11 to 15 and judges whether a gap is formed between the preceding postal matter P transferred to the conveying structure 7 and conveyed and the succeeding postal matter P or not (Step S6). When the preceding postal matter P taken out first is only one taken out normally from the take-out position 20, the second postal matter P is at the take-out position 20 due to the action of the separation structure 5, thus that the rear end of the preceding first postal matter P in the take-out direction is detected via the sensor 11 on the uppermost stream side results in that the gap between the postal matter P is detected.

However, when two postal matter P are taken out on the conveying path 101 in an only slightly stacked state, it is not found which sensor will be turned light hereafter. Or, there are possibilities that unless the sensors 11 to 15 are all turned light, the two postal matter P may be conveyed in the stacked state. Furthermore, when any of the sensors 11 to 15 is turned light, the succeeding second postal matter P is not transferred to the conveying structure 7, from this point of time, a speed difference appears between the two postal matter P. Therefore, according to the sensor interval for detecting the gap, a difference appears in the time for causing the speed difference and the gap is changed. Therefore, to prevent the gap from spreading unnecessarily and keep it constant as far as possible, it is desirable to arrange many sensors on the upstream side of the sensor 15. Namely, in this embodiment, the four gap sensors 11 to 14 are arranged on the upstream side of the sensor 15, though the number of gap sensors can be set optionally.

When any of the sensors 11 to 15 is turned light at Step S6 and the gap is detected (YES at Step S6), the control portion 200, on the basis of the time until the sensor itself detecting the passing of the rear end of the preceding postal matter P and detecting the gap detects the passing of the leading edge of the succeeding postal matter P and the reduced speed Vp1, calculates the length of the concerned gap and compares it with the specified gap required by the concerned processing apparatus 100. And, the control portion 200, so as to make the actual gap calculated coincide with the specified gap, finely adjusts the moving speed of the take-out belt 34. Namely, when the calculated gap does not meet the specified gap, the control portion 200 judges it as a short gap (YES at Step S7) and corrects the moving speed of the take-out belt 34 to Vp' (<Vp) (Step 58).

On the other hand, when no gap is detected via the sensors 11 to 15 at Step S6 (NO at Step S6), the control portion 20, via the sensor 16 arranged furthermore on the downstream side, monitors the passing of the leading edge of the preceding postal matter P (Step S9). As mentioned above, the sensor 16 is arranged at the position where the distance from the leading edge of the postal matter P, arranged at the take-out position 20, in the take-out direction almost coincides with the length of the largest postal matter P processed by the processing apparatus 100, so that the rear end of the postal matter P the leading edge of which is detected by the sensor 16 is at least off the take-out position 20.

Nevertheless, when any of the sensors 11 to 15 is not turned light at the point of time when the passing of the leading edge is detected by the sensor 16 (NO at Step S6, YES at Step S9), it may be considered that the concerned postal matter P is not separated completely form and is stacked with the succeeding postal matter P. Therefore, in such a case, the control portion 200 increases the negative pressure by the vacuum pump 33, increases the absorbing force by the take-out structure 3 (Step S10), and further reduces the moving speed of the take-out belt 34 to a speed of Vp2 (Step S11). In this embodiment, the moving speed Vp2 at this time is set at 0 [m/s]. Namely, in this embodiment, in such a case, the take-out belt 34 is stopped. However, the second speed reduction is not limited to zero and a speed lower than at least Vp1 is acceptable.

Therefore, to the succeeding postal matter P highly possible of double feed, stronger brakes can be applied and the separation operation can be assisted.

Hereafter, the control portion 200 monitors the output of the sensors 11 to 16 and judges whether a gap is formed between the preceding postal matter P conveyed by the conveying structure 7 and the succeeding postal matter P or not (Step S12). And, when a gap is formed between the two postal matter P by the speed reduction control of the take-out belt 34 and the separation torque by the separation structure 5 for bearing originally the separation operation and any of the sensors 11 to 16 is turned light (YES at Step S12), the control portion 200, as explained at Step S7, calculates the gap between the preceding postal matter P and the succeeding postal matter P, compares it with the specified gap, and when a short gap appears (YES at Step S7), corrects the gap (Step S8).

Further, in this case, there are possibilities that the passing of the rear end of the succeeding postal matter P of the two double-fed postal matter P may be detected, so that in such a case, it is necessary to judge the double feed by the latter stage processing portion and reject it.

The aforementioned process is continued until the postal matter P in the insertion portion 2 are all gone (YES at Step S13) and the processing operation is finished. When there is residual postal matter P to be processed in the insertion port 2 (NO at Step S13), the apparatus returns to the process at Step S1, permits the take-out structure 3 to generate a negative pressure, restarts the movement of the take-out belt 34, and continues the process.

As mentioned above, according to this embodiment, at the timing that the preceding postal matter P taken out on the conveying path 101 is transferred to the conveying structure 7 and is held and restricted, when the take-out belt 34 is reduced in speed and furthermore the preceding postal matter P is conveyed to the sensor 16 unless a gap is formed between the preceding postal matter P and the succeeding postal matter P, the take-out belt 34 is furthermore reduced in speed, so that all the postal matter P can be taken out stably independently of the length of the postal matter P. Particularly, according to this embodiment, the gap between the postal matter P can be controlled to a desired gap highly precisely without widening it unnecessarily and the separation operation by the separation structure 5 can be assisted.

Further, according to the embodiment aforementioned, at the timing that the leading edge of the taken-out postal matter P is held and restricted by the conveying structure 7, the take-out belt 34 of the take-out structure 3 is reduced in speed, and the vacuum pump 33 is turned off, thus the absorbing force is controlled so as to be eliminated, though the absorbing force is not always necessarily decreased and only speed control of the take-out belt 34 is acceptable.

On the other hand, when continuously taking out the postal matter P on the conveying path by the aforementioned method, if the double-fed postal matter P are separated halfway and a gap is formed between the two, it is not found that at what position on the conveying path the gap is detected. Therefore, particularly, when the second postal matter P taken out in the state that it is stacked on the first postal matter P is smallest postal matter, even if it is intended to widen the gap detected after separation, the second postal matter P comes off the take-out position and the speed reduction control for the second postal matter P may be not executed. If this occurs, the two postal matter P are transferred to the conveying structure 7 in the state that no sufficient gap is formed between them and are conveyed to the latter stage processing portion. Further, it may be considered that there are possibilities of continuous occurrence of such a short gap.

Particularly, if a short gap occurs continuously, for example, even if it is intended to spread the gap by the correction portion (described later) on the downstream side of conveyance, there are not sufficient gaps before and after the postal matter P to be controlled and no gap can be corrected. In this case, a plurality of postal matter with continuous short gaps formed are all rejected.

Therefore, the inventors of the present invention delay slightly the take-out of the postal matter P to be taken out next to the postal matter P not in time for gap correction, thereby ensure a margin for gap correction, and can correspond to the continuous short gaps. In other words, to correct the continuous short gaps, there is no other method available than the method, at the time of take-out, for instantaneously judging continuous short gaps and delaying the postal matter P under take-out.

Hereinafter, a postal matter processing apparatus 300 having such a function relating to the embodiment of the present invention (hereinafter, referred to as just the processing apparatus 300) will be explained by referring to FIG. 5. The processing apparatus 300 is characterized in that it has a correction portion for correcting the gap of the postal matter P after taken out on the conveying path and it is an example of the sheet processing apparatus of the present invention. Further, here, to the components having the similar functions to those of the processing apparatus 100 aforementioned, the same numerals are assigned and the detailed explanation thereof will be omitted.

Figure 5:
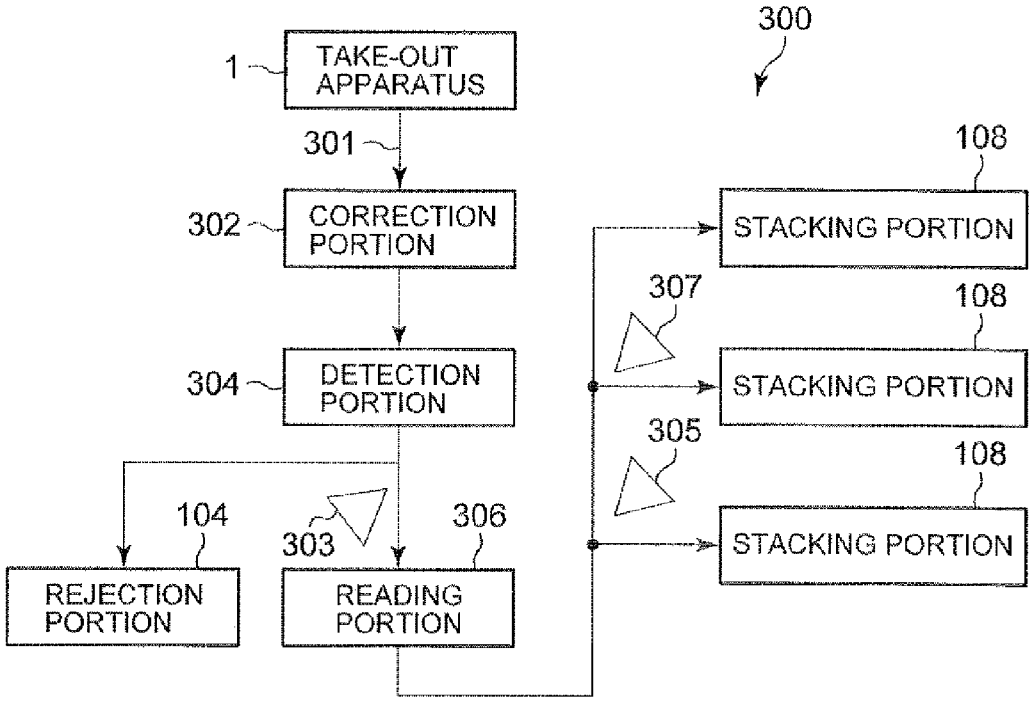
FIG. 5 is a block diagram showing the constitution of the postal matter processing apparatus having the correction portion on the downstream side of the take-out apparatus.

As shown in FIG. 5, the processing apparatus 300, in addition to the take-out apparatus 1 having the same structure as that of the embodiment aforementioned, includes a correction portion 302, a detection portion 304, the rejection portion 104, a reading portion 306, and three stacking portions 108. Further, on a conveying path 301 extending on the downstream side of the take-out apparatus 1, a plurality of gates 303, 305, and 307 for switching the conveying direction of the postal matter P are provided. Namely, the gate 303 selectively switches the conveying direction of the postal matter P between the rejection portion 104 and the reading portion 306 and the gates 305 and 307 direct the postal matter P to the designated stacking portion 108.

Postal matter is set in the take-out apparatus 1 in the stacking state and if the take-out apparatus 1 is operated as described later, it is taken out one by one on the conveying path 301. On the conveying path 301, a plurality of endless conveying belts not drawn are extended so as to hold the conveying path 301 and the postal matter is held by and conveyed on the conveying belt.

The postal matter taken out on the conveying path 301 is conveyed via the correction portion 302, is corrected here in the screw and gap, and is sent to the detection portion 304. Particularly, in this embodiment, the correction portion 302 adjusts the conveying speed of the postal matter conveyed continuously via the conveying path 301, thereby adjusts the gaps before and after the concerned postal matter.

The detection portion 304 detects double feed of postal matter, a short gap, the thickness, and height. And, the postal matter which is judged as off the specification via the detection portion 304 is conveyed to the rejection portion 104 via the gate 303. Namely, the postal matter which passes the correction portion 302, though cannot correct the short gap is rejected to the rejection portion 104.

The postal matter sent to the reading portion 306 via the gate 303 is read the information on the sorting destination such as the address. And, the postal matter passing the reading portion 306 is sorted and stacked on the designated stacking portion 108 via the gates 305 and 307 which are selectively switched on the basis of the reading results at the reading portion 306.

Next, the operation of the take-out apparatus 1 incorporated in the processing apparatus 300 will be explained by referring to the flow chart shown in FIG. 6. Further, the take-out apparatus 1 has the same structure as that of the take-out apparatus 1 incorporated in the processing apparatus 100 of the embodiment aforementioned, so that here, for the apparatus constitution, FIGS. 2 and 3 will be referred to properly.

Figure 6:
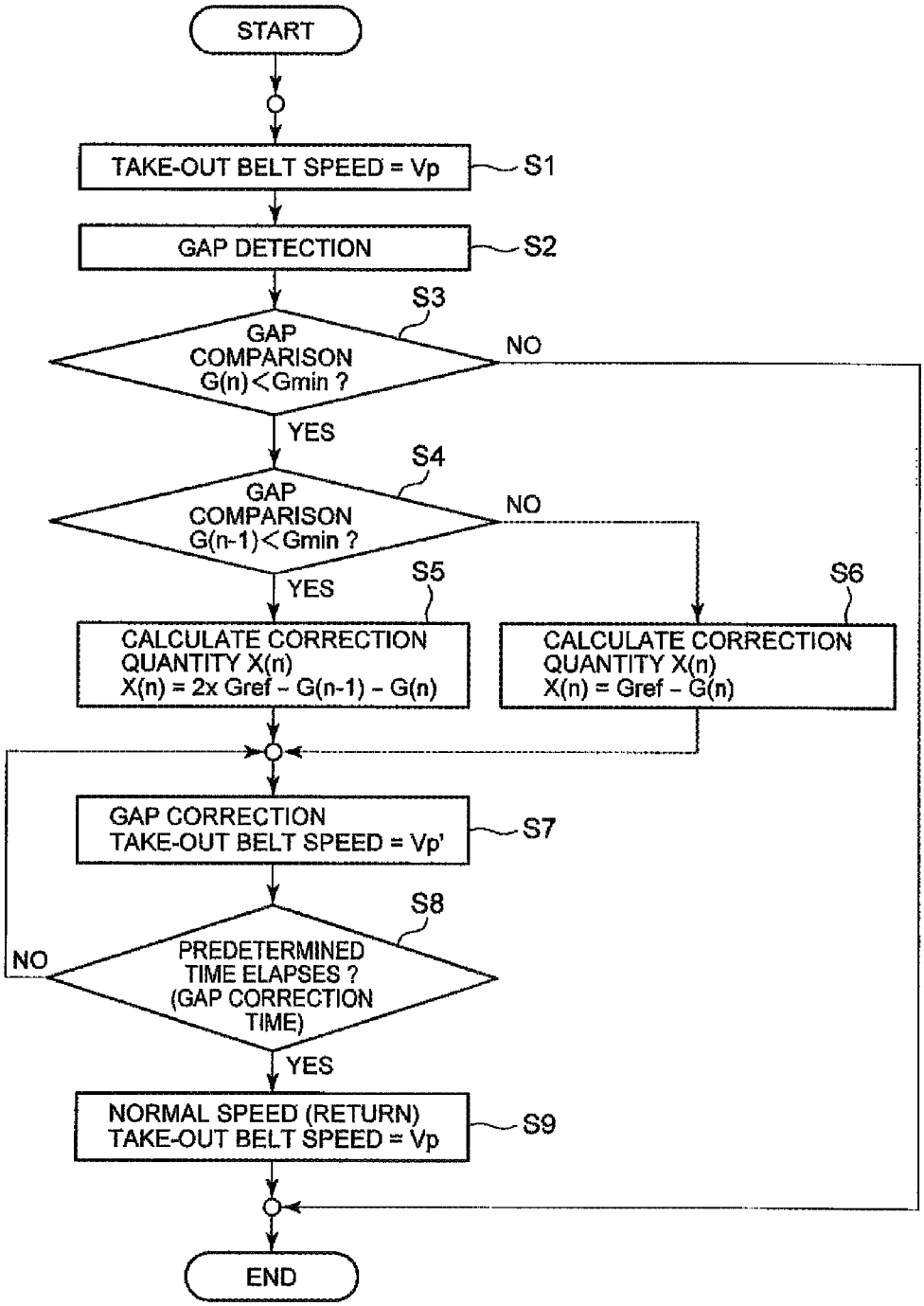
FIG. 6 is a flow chart for explaining the operation of the take-out apparatus incorporated in the processing apparatus shown in FIG. 5.

The control portion 200 drives the motor 35 firstly, moves the take-out belt 34 at a speed of Vp [m/s] in the take-out direction (in the direction of the arrow T), operates the vacuum pump 33 of the take-out structure 3, evacuates the chamber 31, opens the electromagnetic valve 33*a*, thereby permits the take-out belt 34 to generate absorbing force (Step S1 shown in FIG. 6). By doing this, the postal matter P supplied to the take-out position 20 by the supply structure 30 aforementioned is discharged on the conveying path 101. At this time, the initial moving speed Vp [m/s] of the take-out belt 34 is set at almost the same speed as the conveying speed Vc [m/s] of the postal matter P by the conveying structure 7 on the downstream side.

The take-out structure 3, for example, operates similarly to the take-out structure 3 of the take-out apparatus 1 incorporated in the processing apparatus 100 of the embodiment aforementioned and so that the gap between the postal matter P taken out and conveyed on the conveying path 301 approaches a target value Gref as near as possible, continuously takes out the postal matter P supplied to the take-out position 20 on the conveying path 301 at a fixed gap. In this embodiment, the target value Gref of the gap is set to 100 [mm].

And, if the take-out operation at Step S1 is started, the control portion 200 monitors the output of the plurality of sensors 11, 12, 13, 14, and 15 and detects the actual gaps between all the postal matter P taken out on the conveying path 301 by the take-out belt 34 (Step 2). Namely, at this time, the control portion 200, when any of the sensors 11 to 15 is turned dark from light, detects the passing of the leading edge of the postal matter P(n) taken out at the "n"th time, counts the elapsed time after detection of the passing (form dark to light) of the rear end of the "n−1"th postal matter P(n−1) conveyed precedingly by the same sensor, and on the basis of the elapsed time and the conveying speed Vp of the postal matter P(n) and P(n−1), detects the gap between the two postal matter P.

More concretely, the control portion 200 detects an initial gap G(n) between the "n"th postal matter P(n) and the "n−1"th postal matter P(n−1) when any of the sensors 11 to 15 firstly detects the passing of the leading edge of the "n"th postal matter P(n) and as described later, a gap G'(n) after controlling the operation of the take-out structure 3 and correcting the gap G(n). In other words, the control portion 200, for all the postal matter P taken out on the conveying path 301, always monitors the change in the preceding and subsequent gaps. And, the control 200, on the basis of the detected gaps, controls the take-out operation of the postal matter P(n) in the controllable state, that is, the postal matter P(n) under take-out by the take-out belt 34 and adjusts the gaps of all the postal matter P.

For example, when detecting the gap G(n) (the first gap) before correction of the "n"th postal matter P(n) (the first sheet), the control portion 200 compares the detected gap G(n) with the minimum gap Gmin (threshold value) (Step S3). The minimum gap Gmin mentioned above is a minimum value when the processes of the reading portion 306 and stacking portion 108 which are arranged on the downstream side of the take-out apparatus 1 in the conveying direction can be performed and the switching operation of the gates 303, 305, and 307 is in time and the conveyance on the conveying path 301 includes variations. Namely, the two postal matter P(n) and P(n−1) the gaps of which are smaller than the minimum gap Gmin are to be rejected as short gap postal matter. In this embodiment, the minimum gap Gmin which is the threshold value of the short gap is set at 50 [mm].

As a result of the comparison at Step S3, when judging that the gap G(n) of the "n"th postal matter P(n) is Gmin or wider (NO at Step S3), the control portion 200 judges that the gap correction for the concerned postal matter P is not necessary for the present and finishes the process. Namely, in this case, the take-out operation control for the "n"th postal matter P(n) is not executed and it is conveyed as it is via the conveying path 301. Or, at this time, the control portion 200, when the detected gap G(n) is little changed from the minimum gap Gmin, as described in the aforementioned embodiment, the take-out operation of the "n"th postal matter P(n) may be controlled so as to bring the gap G(n) close to the gap Gref.

On the other hand, at Step S3, when judging that the gap G(n) of the "n"th postal matter P(n) is a short gap smaller than Gmin (YES at Step S3), the control portion 200 compares the gap G(n−1) (the second gap) of the "n−1"th postal matter P(n−1) (the second sheet) which is taken out precedingly with Gmin (Step S4). At this time, the controller 200 does not control immediately the take-out operation of the concerned postal matter P(n) so as to bring the gap G(n) of the postal matter P(n) close to the gap Gref.

As a result of the comparison at Step S4, when judging that the gap G(n−1) is a short gap smaller than Gmin (YES at Step S4), the control portion 200 judges that the short gap is continued at least two times and calculates the correction quantity X(n) of the controllable postal matter P(n) under take-out by the take-out belt 34 (Step S5). At this time, the control portion 200, so as to widen the gap G(n) of the postal matter P(n) larger than the target vale Gref, calculates the correction quantity X(n) for controlling the moving speed of the take-out belt 34.

Namely, among the continuous short gaps, to correct the gap G(n−1) on the downstream side under the take-out operation already, which cannot be corrected, by the correction portion 302 on the downstream side in the conveying direction, it is necessary to reduce the conveying speed of the postal matter P(n−1), widen the gap G(n−1) between the postal matter P(n−1) and the postal matter P(n−2) (the third sheet) which is taken out further precedingly from the postal matter P(n−1), and hereafter, reduce the conveying speed of the postal matter P(n), and widen the gap G(n) between the postal matter P(n−1) and the postal matter P(n), though under the take-out control, if the gap G(n) of the postal matter P(n) taken out thirdly is only adjusted to the target value Gref, when reducing the conveying speed of the middle postal matter P(n−1) by the correction portion 302, the gap G(n) on the upstream side thereof becomes shorter than the target value Gref. Therefore, in this embodiment, in consideration of the correction quantity of the gap G(n−1) on the downstream side in the conveying direction, the gap G(n) on the upstream side in the conveying direction is widened larger than the target value.

Concretely, the correction quantity X(n) in this case is set to the value obtained by subtracting the gap G(n−1) on the downstream side and the gap G(n) on the upstream side, which are detected, from the doubled value of the target value Gref. By doing this, the correction portion 302 can correct the two gaps G(n−1) and G(n) respectively to the target value Gref.

On the other hand, when judging at Step S4 that the gap G(n−1) is Gmin or wider (NO at Step S4), there is no need to correct the gap G(n−1) by the correction portion 302, so that the control portion 200 calculates the correction quantity X(n) for correcting only the gap G(n) of the controllable postal matter P(n) to the target value Gref (Step S6). Namely, the correction quantity X(n) in this case is the value obtained by subtracting G(n) from Gref. However, also in this case, when the gap G(n−1) is a value close to the minimum gap Gmin, in consideration of a correction for slightly widening G(n−1), it is possible to increase slightly the correction quantity X(n).

In any way, the control portion 200, on the basis of the correction quantity X(n) calculated at Step S5 or S6, delays the take-out timing for the postal matter P(n) under take-out. In this case, the control portion 200, from the point of time when the initial gap G(n) of the concerned postal matter P(n) is detected at Step S2, reduces the speed of the take-out belt 34 from Vp [m/s] to Vp' [m/s] (Step S7) and reduces the take-out speed for the postal matter P(n) until the gap G'(n) after correction reaches G(n)+X(n) (YES at Step S8). At this time, the gap correction time T [s] for reducing the speed of the take-out belt 34 is T=X(n)/Vp'.

And, after the gap correction time T [s] elapses (YES at Step S8), the control portion 200 returns the moving speed of the take-out belt 34 from Vp' [m/s] to Vp [m/s] (Step S9) and waits for the process for the next postal matter P(n+1).

As mentioned above, according to this embodiment, when it is detected that the gap G(n) of the postal matter P(n) under take-out is a short gap, to add it to the gap correction quantity of the concerned postal matter P(n) by referring to the gap G(n−1) of the preceding postal matter P(n−1), even when the short gap is continued, such a gap margin as capable of correcting the short gap by the correction portion 302 on the downstream side can be given. Namely, as described in this embodiment, when the preceding gap is corrected, if the next gap is about to be closed, the gap G(n) of the postal matter P(n) is made sufficiently wide, thus the gaps of all the postal matter P passing through the correction portion 302 can be controlled to an appropriate value.

By doing this, the rejection rate due to a short gap can be lowered and in correspondence to it, the processing efficiency can be increased. Particularly, in this embodiment, the correction quantity when the short gap is continued is adjusted to a minimum value, that is, the correction quantity is adjusted so that the averaged gap becomes constant, so that the gap between the postal matter P after passing through the correction portion 302 can be made almost equal to the target value Gref, and the rejection rate can be lowered without reducing the processing ability.

Further, in the embodiment aforementioned, the case that the take-out speed of the postal matter P(n) under take-out is reduced, thus the continuous short gaps are corrected efficiently is explained. However, for example, when the gap G(n−1) of the preceding postal matter P(n−1) is wider than the target gap Gref, it is possible to add a correction of increasing the take-out speed of the succeeding postal matter P(n) in correspondence to it and closing the gap G(n). By doing this, the gaps of continuous three postal matter P are corrected by the correction portion 302, and then the useless large gaps can be shortened, and in correspondence to it, the processing ability can be increased.

Further, in the embodiment aforementioned, to correct the gap G(n) of the postal matter P(n) under take-out, the case that the preceding gap G(n−1) is referred to is explained. However, the preceding gap G(n−1) may be corrected under the take-out correction, so that it is desirable to refer to the gap G'(n−1) after correction.

Figure 7:
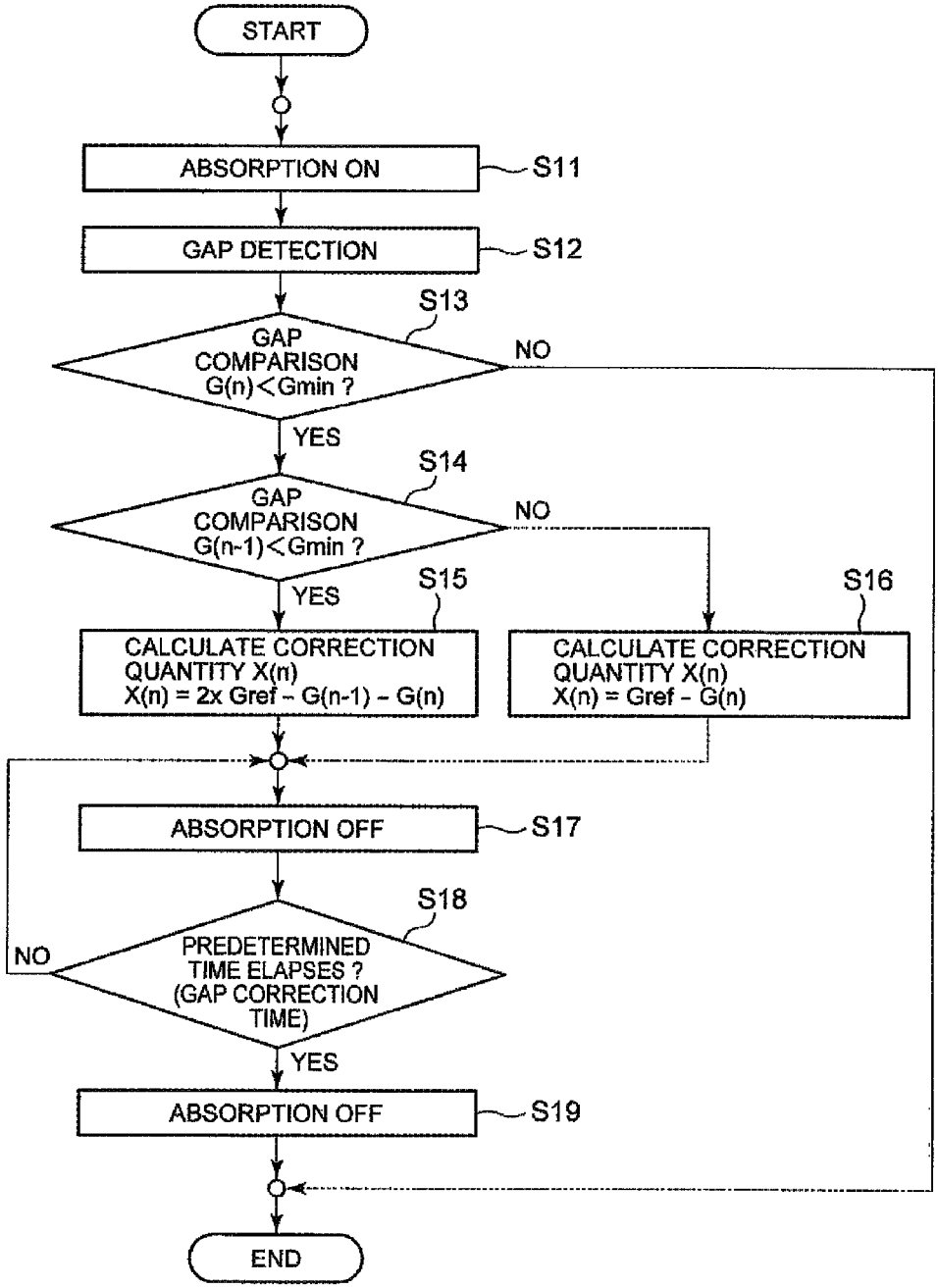
FIG. 7 is a flow chart for explaining an example of switching control of the electromagnetic valve of the take-out apparatus.

Further, in the embodiment aforementioned, when correcting the short gap G(n) on the upstream side on the conveying path among the continuous short gaps, the case that the control of reducing the moving speed of the take-out belt 334 under take-out of the postal matter P(n) is used is explained. However, in place of reducing the moving speed of the take-out belt 34, the control of closing the electromagnetic valve 33*a* and turning off the absorption by the take-out belt 34 may be used. Namely, in this case, the take-out apparatus 1 is operated as shown in the flow chart in FIG. 7.

Namely, after the take-out of the postal matter Pin the state that the electromagnetic valve 33*a* is opened and the absorbing force by the take-out belt 34 is generated (Step S11), the gaps G(n) and G(n−1) are detected via the plurality of sensors 11 to 15 (Step S12) and the gap G(n) of the "n"th postal matter P(n) under take-out is compared with the target value Gmin (Step S13).

Hereafter, when necessary, the preceding gap G(n−1) is also compared with Gmin (Step S14), and the correction quantity X(n) for the postal matter P(n) under take-out is calculated (Steps S15, 816), and for the gap correction time used for calculation (YES at Step S18), the electromagnetic valve 33*a* is closed, and the absorption is turned off (Step S17). And, if the take-out control for the postal matter P(n) is finished, the control portion 200 opens the electromagnetic valve 33*a*, restores the absorbing force (Step 819), and waits for take-out of the next postal matter P(n+1).

As mentioned above, in place of controlling the take-out speed by the take-out belt 34, even if the control of switching the electromagnetic valve 33*a* is used, the same effects as those of the aforementioned embodiment can be produced.

Figure 9:
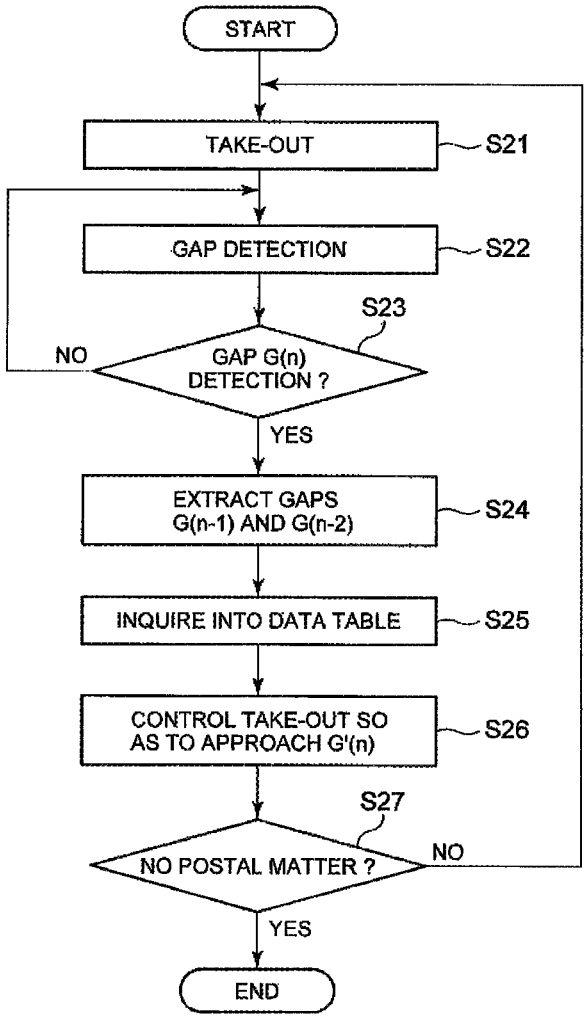
FIG. 9 is a flow chart for explaining the method for referring to the data table shown in FIG. 8 and controlling the take-out operation.

Furthermore, in the embodiment aforementioned, when correcting the gap G(n) of the postal matter P(n) under take-out, the case that only the preceding gap G(n−1) is referred to and the correction quantity X(n) is calculated is explained. However, it is possible to refer to the further-preceding gap G(n−2) when calculating the correction quantity X(n). In this case, for example, as shown in FIG. 8, the data table prepared beforehand is referred to and the take-out apparatus 1 is operated according to the flow chart shown in FIG. 9. Further, in the data table shown in FIG. 8, as most necessary data, only the data when the gap G(n−2) on the lowermost stream side is a short gap (0 to 50 [mm]) is illustrated, though in addition to it, there is data available that the gap G(n−2) is not a short gap.

Firstly, the control portion 200, similarly to the aforementioned embodiment, continuously takes out a plurality of postal matter P on the conveying path 301 (ideally) at a fixed gap Gref (100 [mm]) (Step S21) and for all the postal matter P taken out on the conveying path 301, detects the gaps G(n) and G'(n) before and after correction any number of times with the passage of time (Step S22). The control portion 200 rewrites the detected gaps in real time and stores them in a memory not drawn.

And, the control portion 200, during the take-out operation of the "n"th postal matter P(n), extracts the gaps G(n−1) and G(n−2) (Step S24) at the present time which are stored in the memory by assuming the detection of the gap G(n) as a trigger (YES at Step S23) and inquires into the data table illustrated in FIG. 8 (Step S25).

Hereafter, the control portion 200, so as to approach the ideal gap G'(n) after correction of the "n"th postal matter P(n) extracted by the inquiry at Step S25, on the basis of the gap G(n) at the present time, controls the moving speed and control time of the take-out belt 34 (Step S26) and increases or decreases the take-out speed of the "n"th postal matter P(n). By doing this, the shifts of the gaps G(n−2) and G(n−1) from Gref can be offset and the gaps of postal matter passing through the correction portion 302 on the downstream side on the conveying path can be kept constant.

Further, the aforementioned processes at Steps S21 to S26 are continued until the postal matter P inserted in the insertion portion 2 are all taken out (YES at Step S27).

For example, when the gap G(n−2) of the "n−2"th postal matter P(n−2) extracted at Step S24 is, as shown in FIG. 8, 0 to 50 [mm] and the gap G(n−1) of the "n−1"th postal matter P(n−1) is 50 to 100 [mm], the ideal gap G'(n) of the "n"th postal matter P(n) is 250 [mm]. For example, when the gap G(n) measured at this time is 100 [mm], the correction quantity X(n) becomes +150 [mm] and the control portion 200 controls the take-out operation so as to delay the take-out of the "n"th postal matter P(n) by 150 [mm].

Further, the present invention is not limited straight to the aforementioned embodiments and at the execution stage, within a range which is not deviated from the objects thereof, the components can be modified and realized. Further, by appropriate combinations of a plurality of components disclosed in the aforementioned embodiments, various inventions can be formed. For example, from all the components indicated in the aforementioned embodiments, some components may be deleted. Furthermore, components extending over different embodiments may be combined appropriately.

For example, in the embodiments aforementioned, the case that respectively in the take-out structure 3, separation structure 5, and auxiliary structure 6, the independent vacuum pumps 22, 37, and 57 are provided is explained. However, the present invention is not limited to it and it is possible to connect a plurality of pipes to one vacuum pump and control so as to independently open or close the respective electromagnetic valves.

Further, in the embodiments aforementioned, a negative pressure is generated on the peripheral surface of the separation roller 31 and separation force is given to it or a negative pressure is generated on the peripheral surface of the auxiliary roller 51 and the rotation thereof is controlled, though the present invention is not limited to it and an endless belt may be used in place of the roller.

Furthermore, in the embodiments aforementioned, the structure that the take-out belt 34 makes contact with the postal matter P supplied to the take-out position 20 and takes it out is used, though the present invention is not limited to it and for example, the take-out member to make contact with the postal matter P may be a roller similarly to the separation structure 5.

The sheet take-out apparatus and sheet processing apparatus of the present invention have the constitution and operation as mentioned above, so that the gap for preventing double feed of sheets can be controlled to a desired value.

What is claimed is:

1. A sheet take-out apparatus comprising:

a take-out structure, so as to control gaps between sheets taken-out on a conveying path to a target value, configured to continuously take out a plurality of sheets from a take-out position;

a separation structure configured to separate the overlapped sheets taken-out by the take-out structure and convey the separated sheet to the conveying path;

a gap detection portion configured to detect the gaps between the sheets taken out by the take-out structure and conveyed via the conveying path;

a control portion configured to control the take-out operation of a first sheet by the take-out structure, based on a first gap between the first sheet detected by the gap detection portion and under take-out by the take-out structure and a second sheet taken out and conveyed precedingly on the conveying path, and a second gap between a third sheet taken out and conveyed further precedingly on the conveying path and the second sheet, the control portion adjusting take-out timing of the first sheet by the take-out structure in order to make the total value of the first and second gaps at least larger than a doubled value of the target value; and a correction portion, provided downstream from the conveying path, configured to adjust a conveying speed of the second sheet so that the first gap and the second gap become the target value based on only the first gap and the second gap detected by the gap detection portion.

2. The sheet processing apparatus according to claim 1, wherein the control portion compares the first gap with the target value, when the first gap is separated from the target value beyond a certain threshold value, so as to make the total value of the first and second gaps at least larger than a doubled value of the target value, and adjusts take-out timing of the first sheet by the take-out structure.

3. The sheet processing apparatus according to claim 1, wherein the control portion, so as to make the total value of the first and second gaps equal to almost a doubled value of the target value, adjusts take-out timing of the first sheet by the take-out structure.

4. The sheet processing apparatus according to claim 1, wherein the control portion compares the second gap with the target value, when the second gap is within a certain threshold value from the target value, so as to bring the first gap close to the target value, adjusts take-out timing of the first sheet by the take-out structure.

5. A sheet take-out method comprising:

a step of continuously taking out a plurality of sheets from a take-out position, so as to control gaps between taken-out sheets to a target value;

a step of separating the overlapped sheets taken-out and conveying the separated sheet to a conveying path;

a step of detecting the gaps between the sheets taken out from the take-out position and conveyed via the conveying path;

a step of controlling the take-out operation of the first sheet based on a first gap between a first sheet under take-out from the take-out position and a second sheet taken out and conveyed precedingly on the conveying path, and a second gap between a third sheet taken out and conveyed further precedingly on the conveying path and the second sheet, wherein the step of controlling the take-out operation adjusts take-out timing of the first sheet by the take-out structure in order to make the total value of the first and second gaps at least larger than a doubled value of the target value; and wherein at a downstream from on the conveying path, a step of adjusting a conveying speed of the second sheet so that the first gap and the second gap become the target value based on only the first gap and the second gap detected at the step of detecting gaps.

6. The sheet take-out method according to claim 5, wherein the step of controlling the take-out operation compares the first gap with the target value, when the first gap is separated from the target value beyond a certain threshold value, so as to make the total value of the first and second gaps larger than a doubled value of the target value, adjusts take-out timing of the first sheet.

7. The sheet take-out method according to claim 5, wherein the step of controlling the take-out operation, so as to make the total value of the first and second gaps equal to almost a doubled value of the target value, adjusts take-out timing of the first sheet.

8. The sheet take-out method according to claim 5, wherein the step of controlling the take-out operation compares the second gap with the target value, when the second gap is within a certain threshold value from the target value, so as to bring the first gap close to the target value, adjusts take-out timing of the first sheet.

9. The sheet processing apparatus according to claim 1, wherein the correction portion corrects the second gap so as to widen the second gap by reducing the conveying speed of the second sheet when the second gap smaller than the target value.

10. The sheet processing apparatus according to claim 1, wherein the correction portion corrects the second gap so as to narrow the second gap by accelerating the conveying speed of the second sheet when the second gap larger than the target value.

* * * * *